US007814721B2

(12) United States Patent
Raineri

(10) Patent No.: US 7,814,721 B2
(45) Date of Patent: Oct. 19, 2010

(54) DOUBLE FRET-SHAPED IMPROVED SHEATH FOR LAYING FLOORS AND/OR LININGS WITH TILES, PARQUET, MOQUETTE, WALL-PAPER, PANEL COATINGS AND THE LIKE, AS WELL AS THEIR QUICK PULLING AWAY IN CASE OF THEIR REPLACEMENT

(76) Inventor: Gabriele Raineri, Via Giuseppe Bonaventura, 3, Randazzo (IT) I-95036

( * ) Notice: Subject to any disclaimer, the term of this patent is extended or adjusted under 35 U.S.C. 154(b) by 868 days.

(21) Appl. No.: 11/661,980

(22) PCT Filed: Oct. 5, 2004

(86) PCT No.: PCT/IT2004/000547

§ 371 (c)(1),
(2), (4) Date: Mar. 6, 2007

(87) PCT Pub. No.: WO2005/054598

PCT Pub. Date: Jun. 16, 2005

(65) Prior Publication Data

US 2008/0271397 A1 Nov. 6, 2008

(30) Foreign Application Priority Data

Dec. 4, 2003 (IT) ..... RM2003U0208

(51) Int. Cl.
*E04D 3/30* (2006.01)

(52) U.S. Cl. ..... 52/537; 52/590.1; 52/589.1; 52/443; 52/450

(58) Field of Classification Search ..... 52/537, 52/590.1, 589.1, 443, 450, 453, 177
See application file for complete search history.

(56) References Cited

U.S. PATENT DOCUMENTS

| | | | | | |
|---|---|---|---|---|---|
| 567,985 | A | * | 9/1896 | Olair | 52/177 |
| 570,733 | A | * | 11/1896 | Pettit | 52/572 |
| 2,884,780 | A | * | 5/1959 | Ramirez | 52/570 |
| 3,038,573 | A | * | 6/1962 | Nuernberger | 52/483.1 |
| 3,667,185 | A | * | 6/1972 | Maurer | 52/537 |
| 4,676,042 | A | * | 6/1987 | Bell et al. | 52/543 |
| 4,936,071 | A | * | 6/1990 | Karrfalt | 52/420 |
| D337,169 | S | * | 7/1993 | Schipp | D25/153 |
| 5,402,572 | A | * | 4/1995 | Schulte et al. | 29/897.1 |
| 5,761,867 | A | * | 6/1998 | Carling | 52/386 |
| 5,855,101 | A | * | 1/1999 | Schulte et al. | 52/506.05 |
| 5,857,292 | A | * | 1/1999 | Simpson | 52/22 |

(Continued)

FOREIGN PATENT DOCUMENTS

DE 101 19 057 10/2002

*Primary Examiner*—Richard E Chilcot, Jr.
*Assistant Examiner*—Alp Akbasli
(74) *Attorney, Agent, or Firm*—Young & Thompson

(57) ABSTRACT

A fret-shaped sheath for laying floors and/or linings and their following quick pulling away in case of replacement, including a fixed sheath (1) and a removable sheath (2) able to fit each other by their frets, wherein removable sheath is provided with elements suitably disposed along the joint surfaces between the sheaths and able to form rooms close to the joint surfaces which are prevented from being filled with glue or mortar of cement in order to retain the capability of being deformed of the joint surfaces between the fixed sheath and the removable sheath.

21 Claims, 5 Drawing Sheets

U.S. PATENT DOCUMENTS 5,881,508 A * 3/1999 Irvine et al. ..... 52/177
6,125,607 A * 10/2000 Poce ..... 52/847
6,261,394 B1 * 7/2001 Raineri ..... 156/63
6,286,272 B1 * 9/2001 Sandoz ..... 52/177
6,305,135 B1 * 10/2001 Inaba ..... 52/309.12
6,594,961 B2 * 7/2003 Leines ..... 52/177
6,631,598 B2 * 10/2003 Raineri ..... 52/385
6,691,482 B1 * 2/2004 Ault ..... 52/450
6,959,519 B2 * 11/2005 Adriaansen ..... 52/537
7,121,059 B2 * 10/2006 Pervan ..... 52/592.2
2002/0124501 A1 * 9/2002 Raineri ..... 52/287.1
2004/0093821 A1 * 5/2004 Taenak et al. ..... 52/590.2

* cited by examiner

DOUBLE FRET-SHAPED IMPROVED SHEATH FOR LAYING FLOORS AND/OR LININGS WITH TILES, PARQUET, MOQUETTE, WALL-PAPER, PANEL COATINGS AND THE LIKE, AS WELL AS THEIR QUICK PULLING AWAY IN CASE OF THEIR REPLACEMENT

FIELD OF THE INVENTION

The present invention relates to building and more particularly an improved fret-shaped flexible sheath to be used for laying floors and/or linings of any type to allow their following quick pulling away in case of their replacement as well as a new laying without restoring the concrete bed below.

BACKGROUND OF THE INVENTION

Usually, demolishing works are necessary to replace floors and tile linings as well as moquette, parquet or wall-paper and, in case, also the concrete bed below by means of tools and/or electrical or pneumatic percussion machines with evident well-known troubles involved by such activities as far as both noise and production of dust and debris is concerned and cost and demolition times as well.

Laying methods using sheaths in the name of the same applicant are known, however, the dismantling. i.e. lifting and removing the removable sheaths to which the tiles are applied from the fixed sheath anchored to the bed or the wall is effectively difficult.

These problems are essentially due to the fact that the cement glue used to fix the tiles to the removable sheath fills all rooms and grooves of the fret-shaped sheath, thus hindering the elastic deformation of the joint surfaces between the two (removable and fixed) sheaths and then make it particularly hard and difficult to pull away the tiles.

SUMMARY OF THE INVENTION

The main object of the present invention is to overcome such problems by providing a removable fret-shaped sheath provided with means able to retain the capability of being deformed of the joint surfaces between the two fixed and removable sheaths.

This has been accomplished according to the present invention by providing a removable sheath provided with partitions suitably disposed along the joint surfaces between the two sheaths to prevent the glue or mortar of cement from filling such joint surfaces.

BRIEF DESCRIPTION OF THE DRAWINGS

These and other objects will be more readily apparent from the following detailed description with reference to the accompanying drawings that show just by way of example some preferred embodiments with variations.

In the drawings.

DETAILED DESCRIPTION OF EMBODIMENTS

Figure 1:
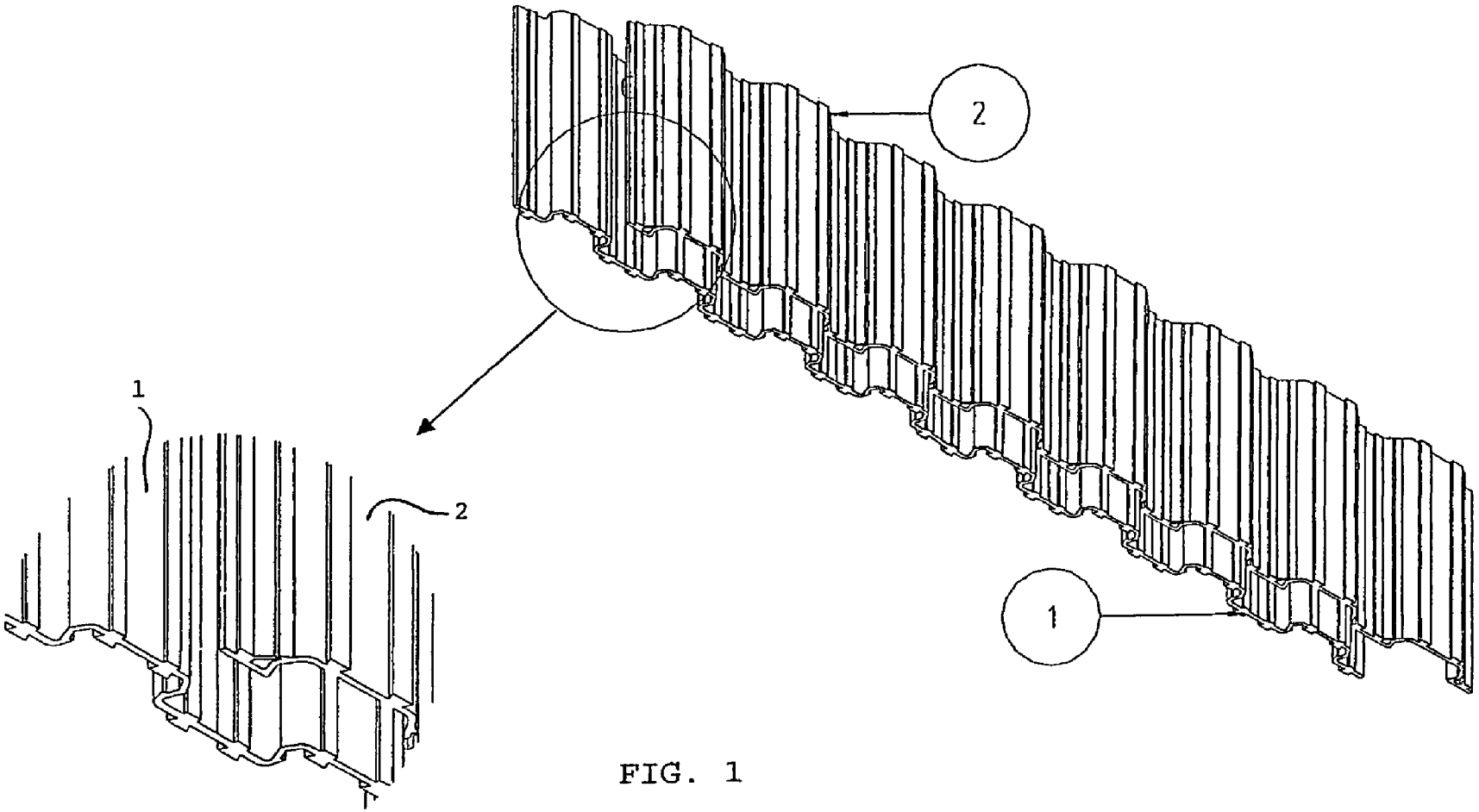
FIG. 1 is a three-dimensional view in which the two fret-shaped fixed and removable sheaths according to a first embodiment of the invention are not assembled on one another, and an enlarged view of a detail.
Figure 2:
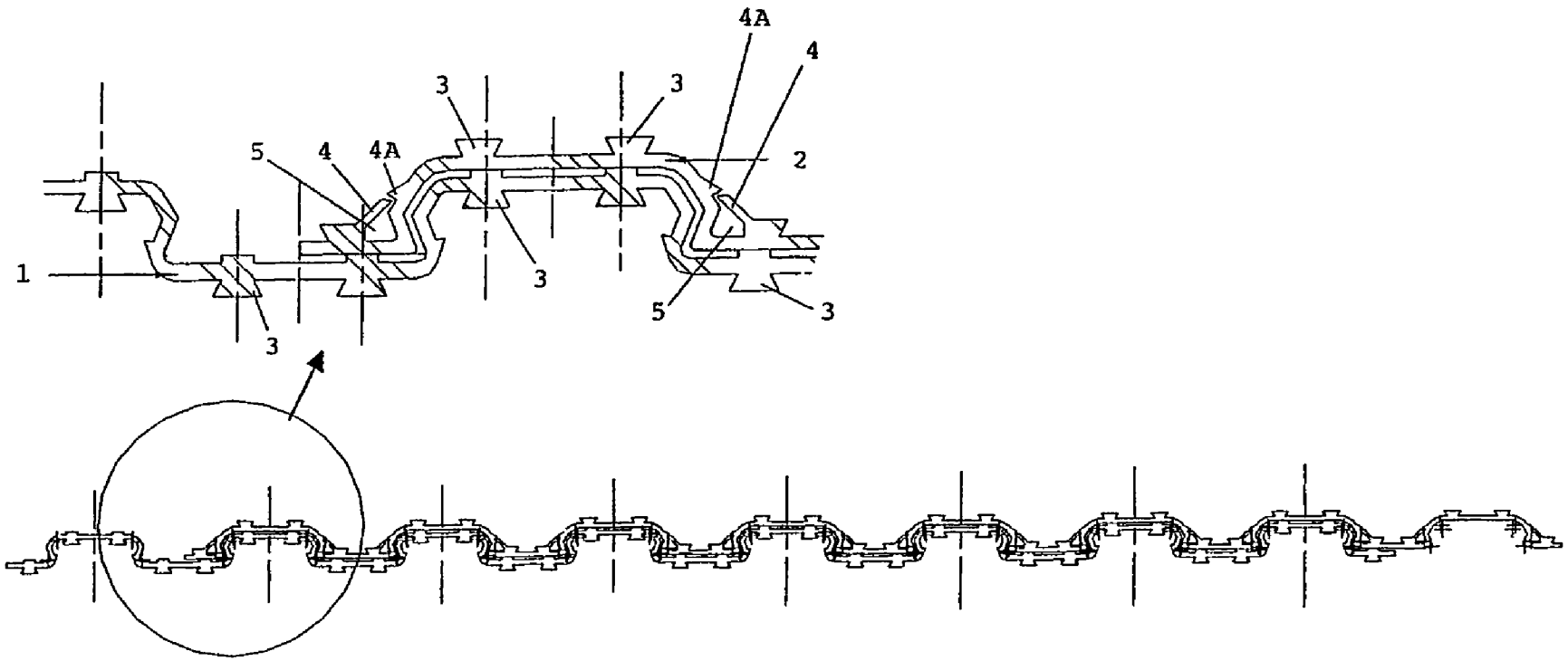
FIG. 2 is a front view of the two sheaths assembled on one another, and an enlarged view of a detail.
Figure 3:
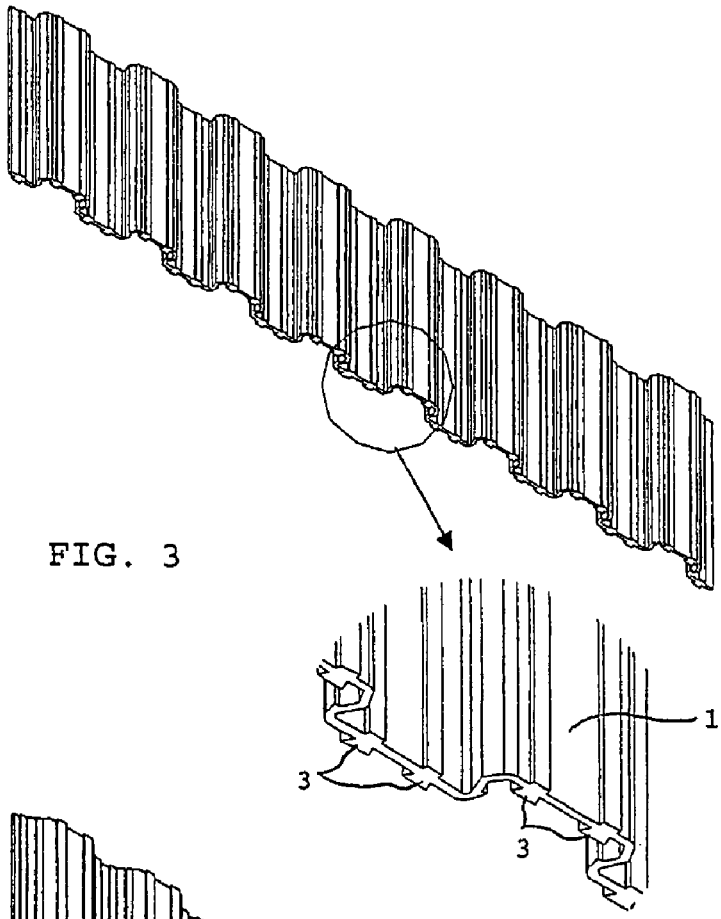
FIGS. 3 and 4 are three-dimensional views similar to the view of FIG. 1 but showing the fixed sheath and the removable sheath, respectively.
Figure 4:
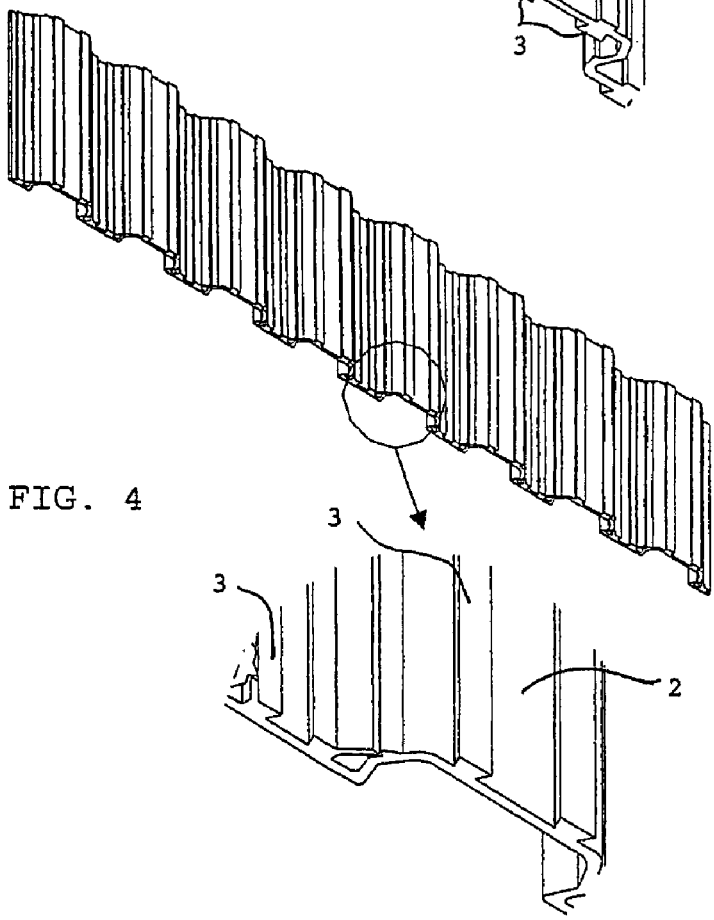

With particular reference to FIG. 2, the disclosed fret-shaped sheaths consists of fixed fret-shaped sheath 1 bound to the concrete bed and a removable fret-shaped sheath 2 which is able to fit the other sheath and on which the plaster is then laid or the tiles or the like are glued.

According to the invention, the recesses and the projections of fixed sheath 1 which are able to fit the projections and the recesses of the removable sheath, respectively, are shaped essentially like a dove tail. Thus, the reciprocal joint between the fret-shaped sheaths is just due to the elasticity of the material which they are made of.

In particular, as the fixed fret-shaped sheath 1 cannot be deformed once the concrete bed of the supporting wall is set, it is evident that only removable sheath 2 is capable of being deformed during removal or dismantling. More specifically, only the sharp corners of the fret projections of removable sheath 2 are capable of being deformed to get free of fixed sheath 1. To this end, according to a peculiar feature of the invention, such corners are provided with means 4 able to prevent the inside room 5 of removable sheath 2 close to said sharp corners from being filled with glue or mortar, the setting of which would prevent said deformation that is necessary for an easy disengagement of the sheaths from each other.

In the disclosed embodiment, said means preventing the inside rooms 5 close to the fitted sharp corners of fixed 1 and removable 2 sheaths from being filled consists of a sloped wall or partition 4 located near each inside corner of removable sheath 2, preferably between the horizontal wall and the adjacent generally vertical wall.

Said sloped wall 4 is parallel to the fret and is fastened to the sheath only by one of its longer side, the other side being freely movable and ending at a short distance from the inside surface of removable sheath 2 to prevent the mortar of cement from filling accidentally room 5 covered by sloped wall 4 that must remain empty to allow the bending and the deformation of the generally vertical walls of the fret with respect to the horizontal wall. An embodiment of said sloped wall 4 can be seen in the enlarged detail of FIG. 2 and in FIG. 5. As can be seen from the figures, it is preferable that a projecting rib 4A acting as a protective shield against the cement glue which will be used, for instance, to glue the tiles is arranged at the free side of the sloped wall 4 on the surface of the removable sheath 2 in order to prevent the glue from entering accidentally the area between sloped wall 4 and the underlying room that must remain empty. Still in FIG. 5 there are shown some variations of sloped wall 4 indicate at B, C and D, respectively. They are able to keep a room free of cement glue at the corners of the projecting portions of the fret-shaped removable sheath 2, which projections fit into corresponding recesses of fixed sheath 1. In the variations shown there, the sloped wall (or partition) B, C and D is fastened longitudinally to removable sheath 2 at both sides and the two walls of removable sheath 2 ending at the corner are separated from each other. In other words, in such variations, sloped wall 4 connects structurally the horizontal wall to its two adjacent, essentially vertical walls.

Figure 5:
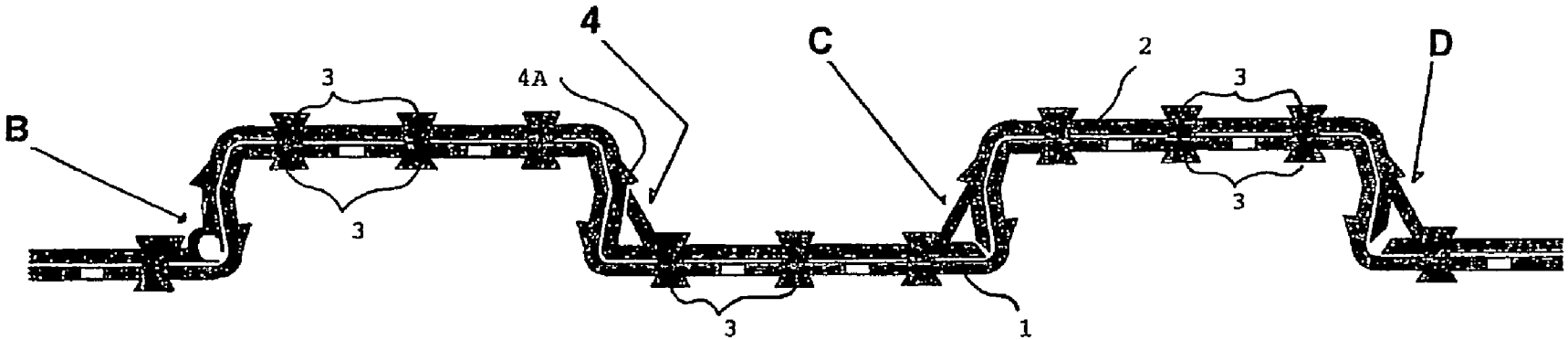
FIG. 5 is a front view of the two sheaths assembled on one another, in which several embodiments of the upper removable sheath are shown.

It should be appreciated that in the variation indicated at B in FIG. 5 said sloped wall is replaced by a kind of hollow bead which is opened longitudinally at the corner facing fixed sheath 1. Also in this case, each bead B connects the horizontal wall of the fret-shaped removable sheath 2 to the adjacent, essentially vertical wall, thus preventing the room at the above-mentioned corner from being filled by the glue for sticking the tiles.

It is self-evident from the foregoing that sloped wall and its variations operate in the same way for any type of floor and wall lining as well.

Figure 7:
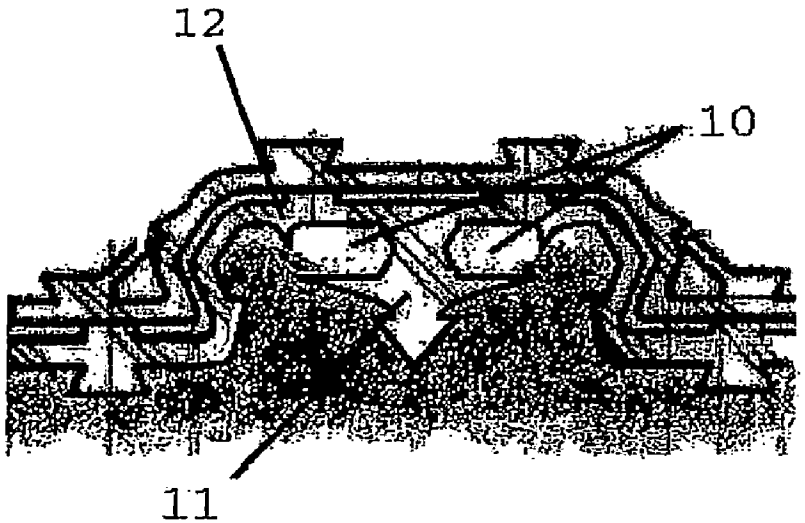
FIG. 7 is a variation of the second embodiment of FIG. 6.
Figure 6:
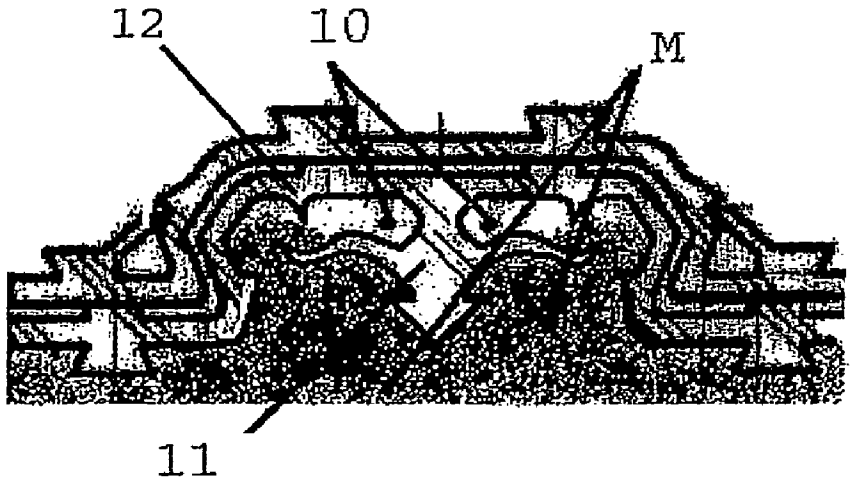
FIG. 6 shows a cross section of a second embodiment of the invention particularly used for concrete beds and/or walls with humidity problems.

A second embodiment of the invention shown in two variations in FIGS. 6 and 7 is particularly advantageous for applications in which the underground bed and/or the walls suffer from particular humidity problems.

In this second embodiment of the invention, there are provided transpiration channels 10 for the outlet of vapour which are preferably disposed just beneath fixed sheath 1 along the fret thereof.

More specifically, said transpiration channels 10 are formed by a bead 11 having a cross section shaped like an umbrella which runs longitudinally inside the fret of fixed sheath 1 and rests with its "wings" or laps on two respective ribs 12 slightly in relief with respect to the surface of the fret so as to form longitudinal channels which are not flooded and/or filled by the glue from the concrete bed or the wall. Thus, according to the present invention, even if the humidity cannot enter directly the two sheaths, it can travel along the fret of channels 10 until the peripheral surfaces of the floor and/or wall and be dispersed to the environment.

The cross section shape of bead 11 can have, for example, corrugated "wings" (FIG. 6) or generally triangular wings as shown in the variation of FIG. 7.

The outer sides of the sheaths are provided with ribs 3 parallel to the fret and also shaped like a dove tail in order to improve the seaming and sticking of fixed sheath 1 to the concrete bed or the wall as well as tiles or plaster to removable sheath 2.

It should be noted that the double sheath according to the present invention can also be used for inside and outside plasters, thus providing a number of advantages including the thermal insulation due to a "thermal shear" given by the two sheaths that are different and separated even if they penetrate each other, and the insulation from humidity as the sheaths are of plastic material and at least one of them is not provided with through-holes.

It should also be appreciated that the use of the double sheath disclosed above to anchor the finishing plasters to the walls cause a clear break to the propagation of cracks and settling between the wall and the plaster. This is particularly advantageous in case of vibrations due to earthquake as injuries to people and things caused by cracks of walls, ceilings and concrete that usually cause plaster and concrete to detach from the walls are suppressed or drastically reduced by the sheaths.

More specifically, the detachment of plaster is prevented by that the fret-shaped sheath according to the present invention provides a mechanical anchorage due to the outside dove-tail scoring or ribbings 3 and the shape of the fret as well.

Moreover, it should be appreciated that said mechanical anchorage and the resistance and elasticity properties of the sheaths, if the latter are also anchored to the walls by means of dowels in addition to cement glue, avoid that the partition walls collapse suddenly to the occupants of the building in case of earthquake as said sheaths act as stiffening means that give stability to the partition walls, outside curtain walls, eaves, etc. Said stabilizing action prevents or slackens the sudden collapse of the walls, even if it does not increase the resistance of the latter, and gives the occupants a longer time to leave the building.

The present invention has been described and illustrated according to some preferred embodiments thereof, however, it is self-evident that those skilled in the art can make a number of technically and/or functionally equivalent modifications and/or changes without departing from the scope of the present industrial invention.

The invention claimed is:

1. A fret-shaped sheath for laying at least one of floors and linings and being configured for quick pulling away in case of replacement, said fret-shaped sheath including:

a fixed sheath; and a removable sheath, said fixed sheath and said removable sheath being configured to fit each other by their frets, wherein said removable sheath is provided with means suitably disposed along joint surfaces between said fixed sheath and said removable sheath and that form compartments close to said joint surfaces between said fixed sheath and said removable sheath which are prevented from being filled with glue or mortar of cement, said compartments each including a space between one of the walls forming said compartment.

2. The sheath according to claim 1, wherein said fixed sheath is provided with recesses and projections which are able to fit the corresponding projections and recesses of said removable sheath, respectively, said recesses and projections being shaped essentially like a dove tail.

3. The sheath according to claim 2, wherein the joint surfaces between said fixed sheath and said removable sheath are made of an elastic material.

4. The sheath according to claim 1, wherein only said removable sheath is capable of being deformed during removal or dismantling, said fixed sheath being prevented from deforming once a concrete bed of a supporting wall for said fret-shaped sheath is set.

5. The sheath according to claim 1, wherein only corners of fret projections of said removable sheath are capable of being deformed to get free of said fixed sheath, said deformation being possible owing to said compartments being free of glue or mortar of cement.

6. The sheath according to claim 1, wherein said means preventing said compartments from being filled consists of a sloped wall located near each inside corner of said removable sheath.

7. The sheath according to claim 6, wherein said sloped wall is parallel to the fret and is fastened to said removable sheath only by one longer side of said sloped wall, an other side of said sloped wall being freely movable and ending at a short distance from an inside surface of said removable sheath to prevent the mortar of cement from filling accidentally said compartment covered by said sloped wall that must remain empty to allow bending and deformation of generally vertical walls of the fret with respect to a horizontal wall.

8. The sheath according to claim 7, further comprising a projecting rib acting as a protective shield against the glue or cement is arranged at the free side of the sloped wall on a surface of the removable sheath in order to prevent the glue from entering accidentally the area between said sloped wall and an underlying one of said compartments that must remain empty.

9. The sheath according to claim 6, wherein the sloped wall is fastened longitudinally to said removable sheath at both sides and two walls of said removable sheath ending at the corner thereof are separated from each other so that said sloped wall connects structurally a horizontal wall of said removable sheath and an adjacent, essentially vertical wall of said removable sheath.

10. The sheath according to claim 6, wherein said sloped wall is a hollow bead which is opened longitudinally at the corner of said removable sheath facing said fixed sheath so that each said bead connects a horizontal wall of the removable sheath to an adjacent, essentially vertical wall of said removable sheath, thus preventing the compartment at said corner from being filled by the glue.

11. The sheath according to claim 1, wherein, for applications in which at least one of an underground bed and walls suffer from particular humidity problems, there are provided transpiration channels for outlet of vapour which are disposed just beneath said fixed sheath along the fret thereof.

12. The sheath according to claim 11, wherein said transpiration channels are formed by a bead of said fixed sheath having a cross section shaped like an umbrella which runs longitudinally inside the fret of said fixed sheath and rests with its "wings" or laps on two respective ribs slightly in relief with respect to a surface of the fret so as to form longitudinal channels which are not filled by the glue from a concrete bed or a wall for said fret-shaped sheath.

13. The sheath according to claim 12, wherein even when humidity cannot enter directly said fixed sheath and said removable sheath, said transpiration channels being configured so that the humidity travels along the fret of said channels until peripheral surfaces of at least one of a floor and a wall formed by said fret-shaped sheath and is dispersed to the environment.

14. The sheath according to claim 12, wherein a cross section shape of said bead has corrugated "wings" or generally triangular wings.

15. The sheath according to claim 1, wherein outer sides of said fixed sheath and said removable sheath are provided with ribs parallel to the fret and also shaped like a dove tail in order to improve seaming and sticking of said fixed sheath to a concrete bed or a wall as well as tiles or plaster to said removable sheath.

16. The sheath according to claim 1, configured for inside and outside plasters, wherein said fixed sheath and said removable sheath provide thermal insulation due to a "thermal shear" given by the two sheaths that are different and separated even if they penetrate each other, and wherein said fixed sheath and said removable sheath are of plastic material so as to provide insulation from humidity and at least one of said fixed sheath and said removable sheath is not provided with through-holes.

17. The sheath according to claim 15, configured for anchoring finishing plasters to walls causes a clear break to propagation of cracks and settling between the wall and the plaster just because of the presence of two sheaths that are different and separated even if they penetrate each other, so that said fret-shaped sheath provides a mechanical anchorage due to the outside dove-tail scoring or ribbings and the shape of the fret as well.

18. The sheath according to claim 17, wherein anchorage of said fixed sheath and said removable sheath to the walls also by means of dowels in addition to cement glue prevents partition walls from sudden collapse suddenly in case of earthquake as said fixed sheath and said removable sheath act as stiffening means that give stability to the partition walls, so that a stabilizing action prevents or slackens the sudden collapse of the walls, even when it does not increase the resistance of the walls, and gives occupants a longer time to leave a building containing the walls.

19. The sheath according to claim 2, wherein only said removable sheath is capable of being deformed during removal or dismantling, said fixed sheath being prevented from deforming once a concrete bed of a supporting wall for said fret-shaped sheath is set.

20. The sheath according to claim 13, wherein a cross section shape of said bead has corrugated "wings" or generally triangular wings.

21. A fret-shaped sheath for laying at least one of floors and linings and being configured for quick pulling away in case of replacement, said fret-shaped sheath including:

a fixed sheath; and a removable sheath, said fixed sheath and said removable sheath being configured to fit each other by their frets and are connected to each other only by their shapes, wherein said removable sheath is provided with means suitably disposed along joint surfaces between said fixed sheath and said removable sheath and that form compartments close to said joint surfaces between said fixed sheath and said removable sheath which are prevented from being filled with glue or mortar of cement.

* * * * *